US007238146B1

(12) United States Patent
Chen

(10) Patent No.: US 7,238,146 B1
(45) Date of Patent: Jul. 3, 2007

(54) ELLIPTICAL EXERCISE APPARATUS

(76) Inventor: James Chen, No. 35, Tung-Hai Rd., Sha-Lu Chen, Taichung Hsien (TW)

( * ) Notice: Subject to any disclaimer, the term of this patent is extended or adjusted under 35 U.S.C. 154(b) by 0 days.

(21) Appl. No.: 11/492,108

(22) Filed: Jul. 25, 2006

(51) Int. Cl.
*A63B 22/00* (2006.01)
*A63B 22/02* (2006.01)

(52) U.S. Cl. ..... 482/52; 482/70

(58) Field of Classification Search ..... 482/51, 482/52, 57, 70, 79–80
See application file for complete search history.

(56) References Cited

U.S. PATENT DOCUMENTS 6,461,277 B2 * 10/2002 Maresh et al. ..... 482/52
6,846,273 B1 * 1/2005 Stearns et al. ..... 482/52
7,060,005 B2 * 6/2006 Carlsen et al. ..... 482/52
* cited by examiner

*Primary Examiner*—Steve R. Crow
(74) *Attorney, Agent, or Firm*—Davidson Berquist Jackson & Gowdey LLP

(57) ABSTRACT

An elliptical exercise apparatus includes a base, an upstanding frame extending upwardly from the base, a crank assembly including left and right crank members connected respectively and rotatably to left and right sides of the upstanding frame, and a link rod assembly including left and right first link rods each having first to third connection points. The first connection point is connected rotatably to the corresponding crank member. The link rod assembly further includes left and right second link rods each having rear and front ends connected pivotally and respectively to the upstanding frame and the corresponding second connection point. A pedal assembly includes left and right pedal rods each having a front connecting section connected rotatably to the corresponding third connection point. The pedal rods are mounted on the base to move in a substantially front-to-rear direction relative to the base.

6 Claims, 8 Drawing Sheets

ELLIPTICAL EXERCISE APPARATUS

BACKGROUND OF THE INVENTION

1. Field of the Invention

The invention relates to an exercise apparatus, more particularly to an elliptical exercise apparatus.

2. Description of the Related Art

Referring to FIG. 1, a first conventional elliptical exercise apparatus 1 is shown to include a main frame 11, a crank assembly 12, left and right link rods 131, 132, and left and right pedal rods 141, 142. The main frame 11 includes a base 113, a first frame part 111 extending upwardly from a front end of the base 113, and a second frame part 112 connected to the first frame part 111. The crank assembly 12 is mounted rotatably on the first frame part 111. Each of the left and right link rods 131, 132 has a first connection point 133 connected rotatably to the crank assembly 12, a second connection point 134 connected pivotally to the second frame part 112 and movable along a predetermined path, and a third connection portion 135 proximate to the first connection point 133. Each of the left and right pedal rods 141, 142 has a first connecting section 143 connected rotatably to the third connection point 135 of the corresponding link rod 131, 132, a pedaling section 144 distal from the first connecting section 143, and a second connecting section 145 between the first connecting section 143 and the pedaling section 144 and connected to the base 113 so as to be movable along a predetermined path. As the pedaling section 144 of each pedal rod 141, 142 is distal from the second frame part 112, i.e., the front end part of the main frame 11, the apparatus 1 is long and bulky.

Referring to FIG. 2, a second conventional elliptical exercise apparatus (1*a*) is shown to include a main frame (11*a*), a crank assembly (12*a*), left and right link rods (131*a*, 132*a*), left and right pedal rods (141*a*, 142*a*), and left and right handles (151*a*, 152*a*). The crank assembly (12*a*) is mounted rotatably on a first frame part (111*a*) of the main frame (11*a*). Each of the left and right link rods (131*a*, 132*a*) has a first connection point (133*a*) connected rotatably to the crank assembly (12*a*), a second connection point (134*a*) connected pivotally to a second frame part (112*a*) of the main frame (11*a*), and a third connection point (135*a*) proximate to the first connection point (133*a*). Each of the left and right pedal rods (141*a*, 142*a*) has a first connecting section (143*a*) connected rotatably to the third connection point (135*a*) of the corresponding link rod (131*a*, 132*a*), a second connecting section (145*a*) distal from the first connecting section (143*a*), and a pedaling section (144*a*) between the first and second connecting sections (143*a*, 145*a*). As the pedaling section (144*a*) of each pedal rod (141*a*, 142*a*) is disposed between the handles (151*a*, 152*a*) and the crank assembly (12*a*), the apparatus (1*a*) is also long and bulky.

FIG. 3 illustrates a schematic side view of a third conventional elliptical exercise apparatus (1*b*). The exercise apparatus (1*b*) includes a main frame (11*b*), a crank assembly (12*b*), left and right link rods (only the right link rod (132*b*) is shown), left and right pedal rods (only the right pedal rod (142*b*) is shown), and left and right handles (only the right handle (152*b*) is shown). The main frame (11*b*) includes a base (113*b*), a first frame part (111*b*) extending upwardly from the base (113*b*), and a second frame part (112*b*) connected to the first frame part (11*b*). The crank assembly (12*b*) is mounted rotatably on the first frame part (111*b*). Each of the left and right link rods (132*b*) has a first connection point (133*b*) connected rotatably to the crank assembly (12*b*), a second connection point (134*b*) connected pivotally to the second frame part (112*b*) through a second link rod (136*b*), and a third connection point (135*b*) proximate to the second connection point (134*b*). Each of the left and right pedal rods (142*b*) has a first connecting section (143*b*) connected rotatably to the third connection point (135*b*) of the corresponding link rod (132*b*), a pedaling section (144*b*) distal from the first connecting section (143*b*), and a second connecting section (145*b*) between the first connecting section (143*b*) and the pedaling section (144*b*). Each of the handles (152*b*) has a lower end connected pivotally to the pedaling section (145*b*) of the corresponding pedal rod (142*b*). Since the second link rod (136*b*) has a rear end pivoted to the right link rod (132*b*) and a front end fixed to the second frame part (112*b*), i.e., the front end part of the main frame (11*b*), the pedaling section (144*b*) of each pedal rod (142*b*) is distal from the front end part of the main frame (11*b*), thereby lengthening the overall length of the apparatus (1*b*).

Because the aforementioned conventional elliptical exercise apparatuses 1, (1*a*), (1*b*) are long and bulky, a substantial space is required for use, storage, and transportation.

SUMMARY OF THE INVENTION

Therefore, the object of the present invention is to provide an elliptical exercise apparatus with a compact size.

According to this invention, an elliptical exercise apparatus comprises a main frame, a crank assembly, a link rod assembly, and a pedal assembly. The main frame includes a base, and an upstanding frame extending upwardly from the base proximate to a front end of the base. The crank assembly includes left and right crank members connected respectively and rotatably to left and right sides of the upstanding frame proximate to a front end of the upstanding frame. The link rod assembly includes left and right first link rods each having a first connection point, a second connection point below the first connection point, and a third connection point below the second connection point. The first connection points of the left and right first link rods are connected respectively and rotatably to the left and right crank members. The link rod assembly further includes left and right second link rods, each of which has two opposite rear and front ends connected pivotally and respectively to the upstanding frame proximate to a rear end of the upstanding frame and the second connection point of a corresponding one of the left and right first link rods. The pedal assembly includes left and right pedal rods each having a front connecting section connected rotatably to the third connection point of a respective one of the left and right first link rods, and a pedal member disposed rearwardly of the front connecting section. The left and right pedal rods are slidable on the base.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
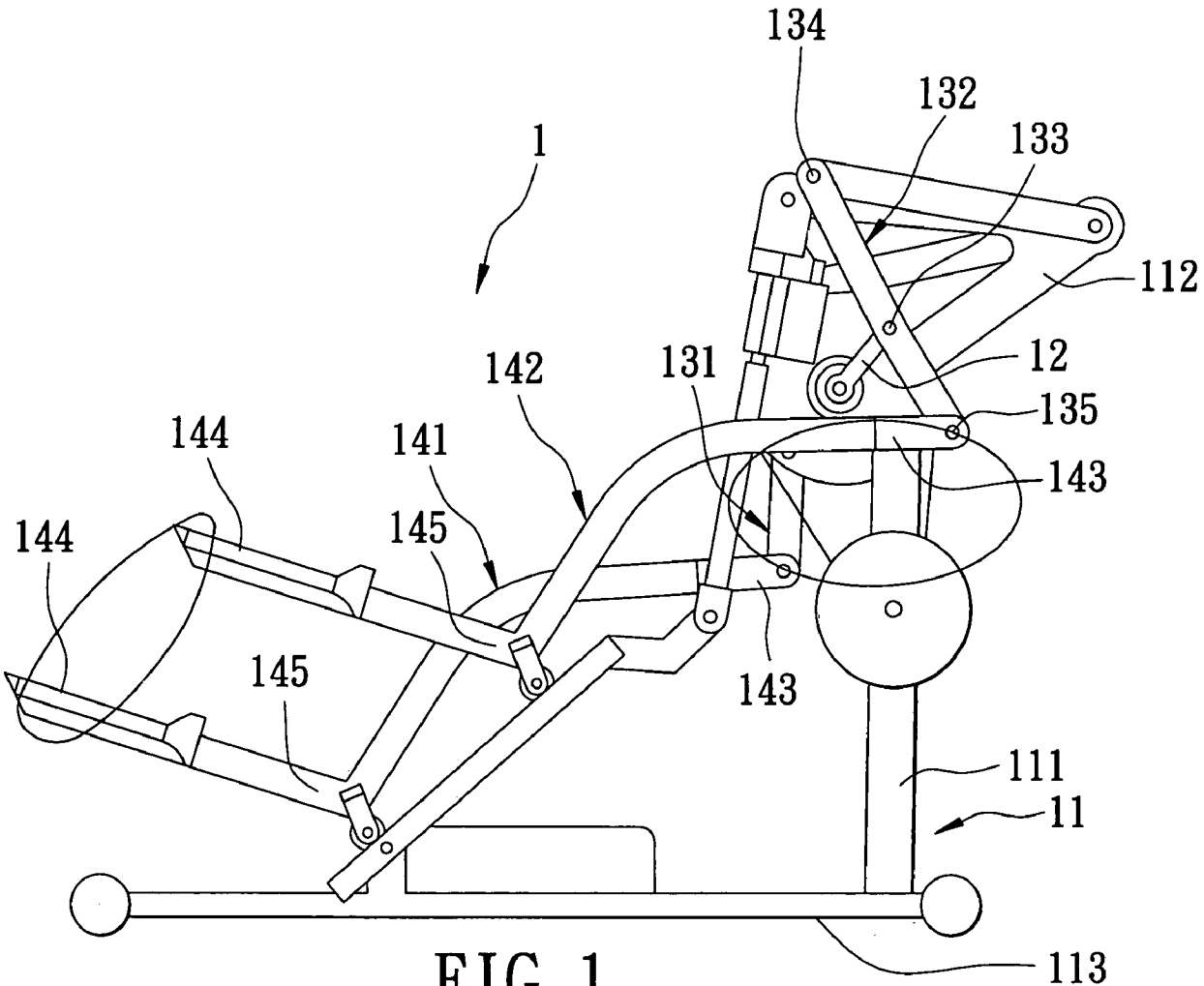
FIG. 1 PRIOR ART
FIG. 1 is a schematic side view of a first conventional elliptical exercise apparatus.
Figure 2:
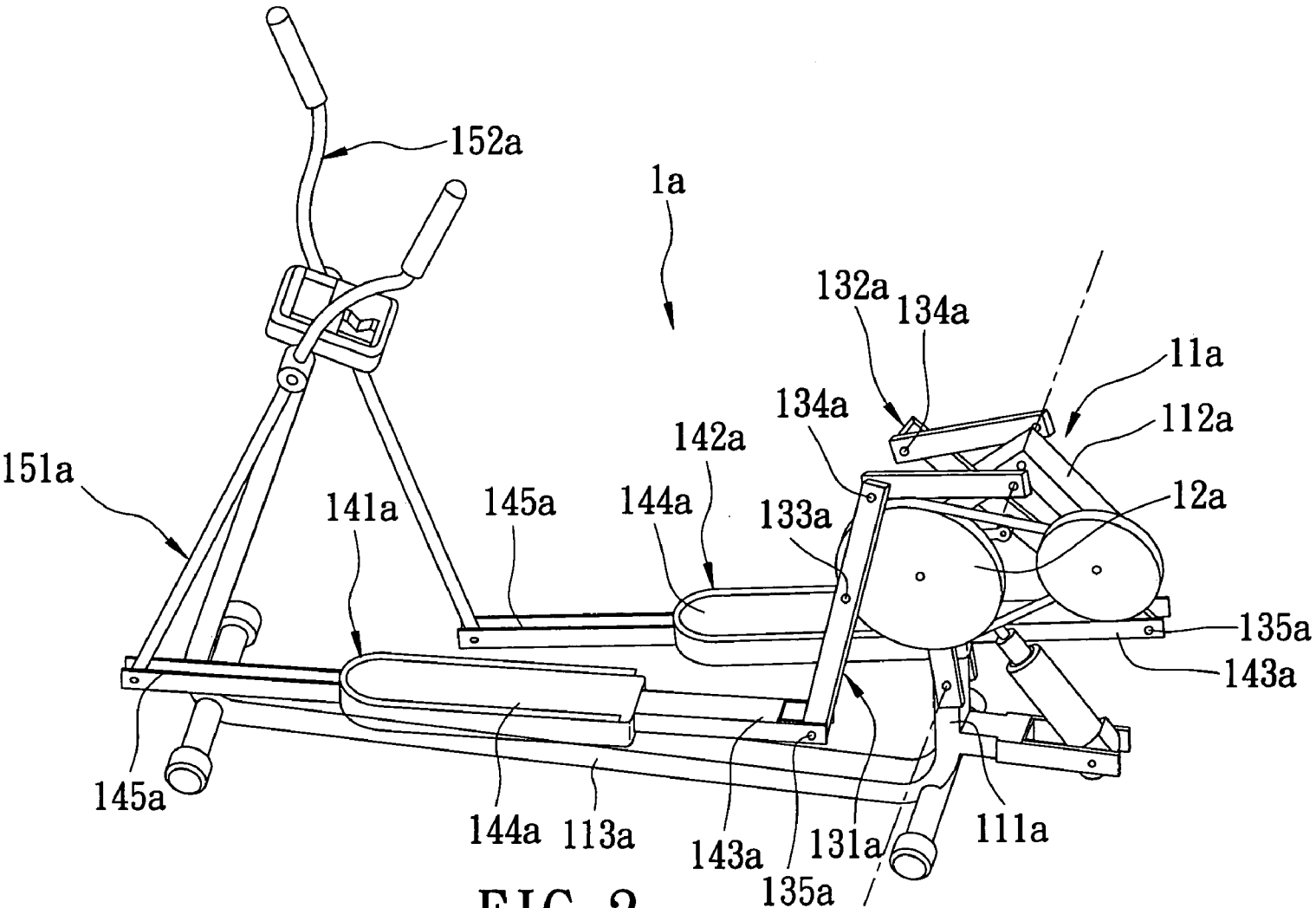
FIG. 2 PRIOR ART
FIG. 2 is a perspective view of a second conventional elliptical exercise apparatus.
Figure 3:
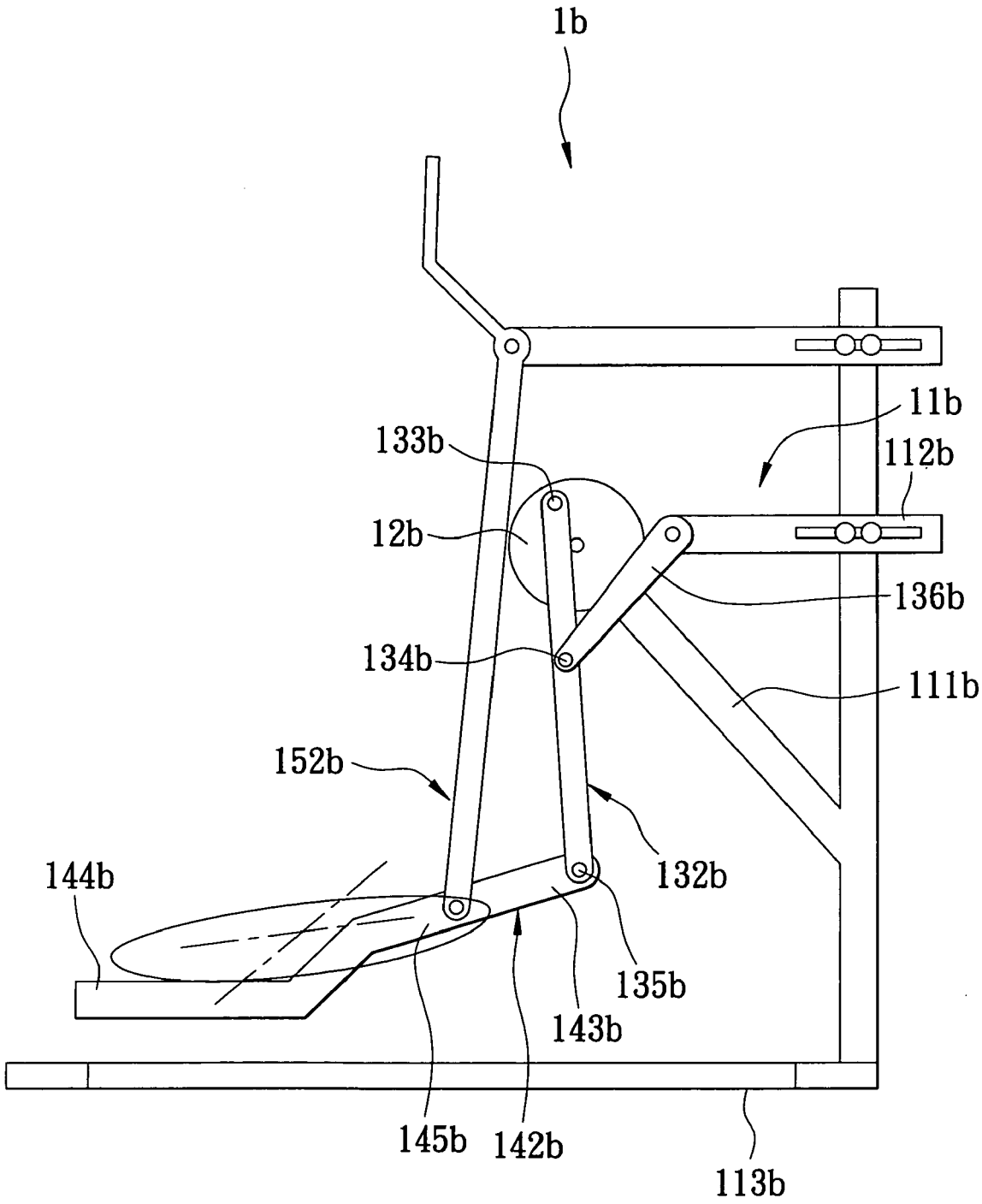
FIG. 3 PRIOR ART
FIG. 3 is a schematic side view of a third conventional elliptical exercise apparatus.

Before the present invention is described in greater detail, it should be noted that like elements are denoted by the same reference numerals throughout the disclosure.

Figure 4:
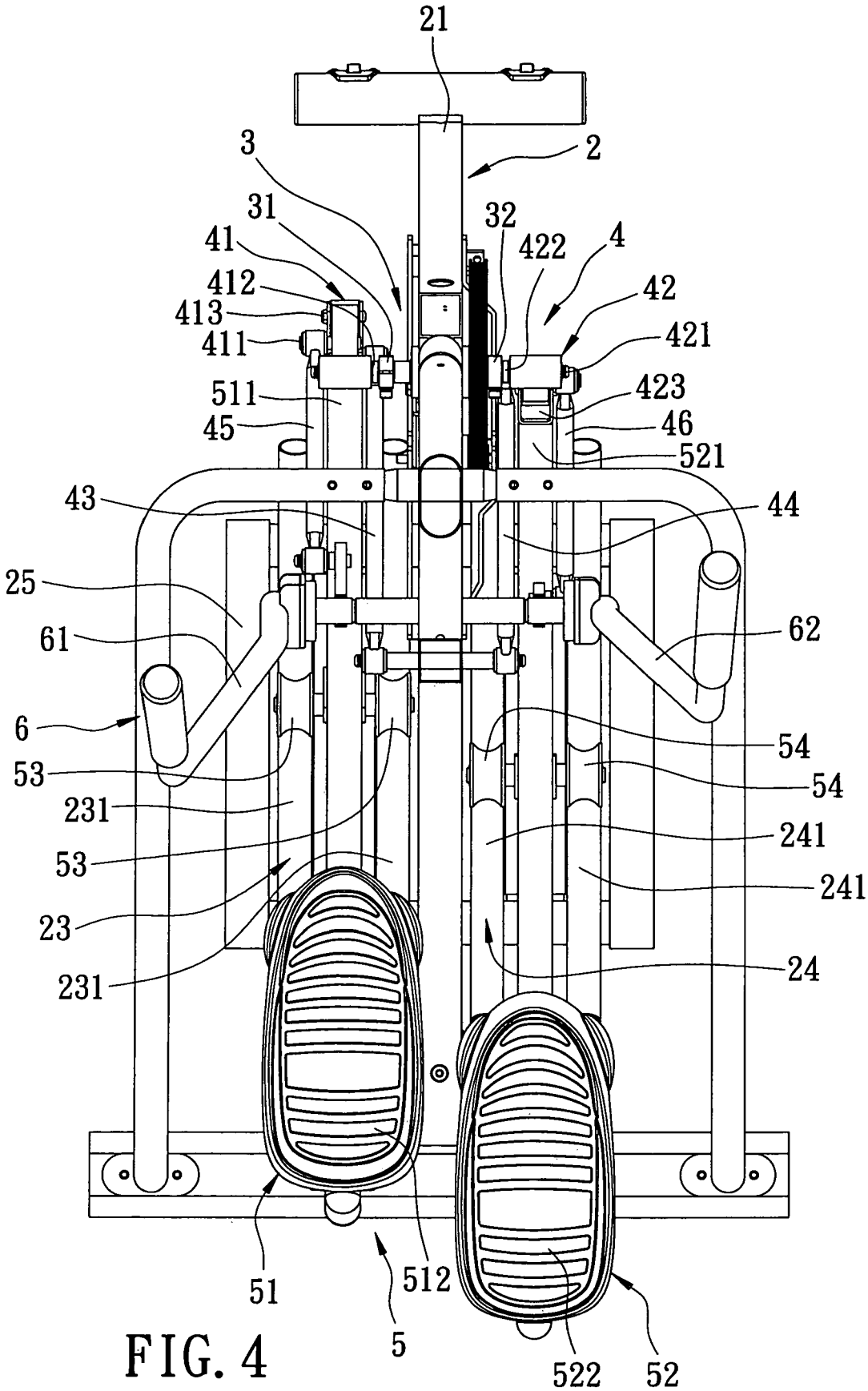
FIG. 4 is a schematic top view of the first preferred embodiment of an elliptical exercise apparatus according to the present invention.
Figure 5:
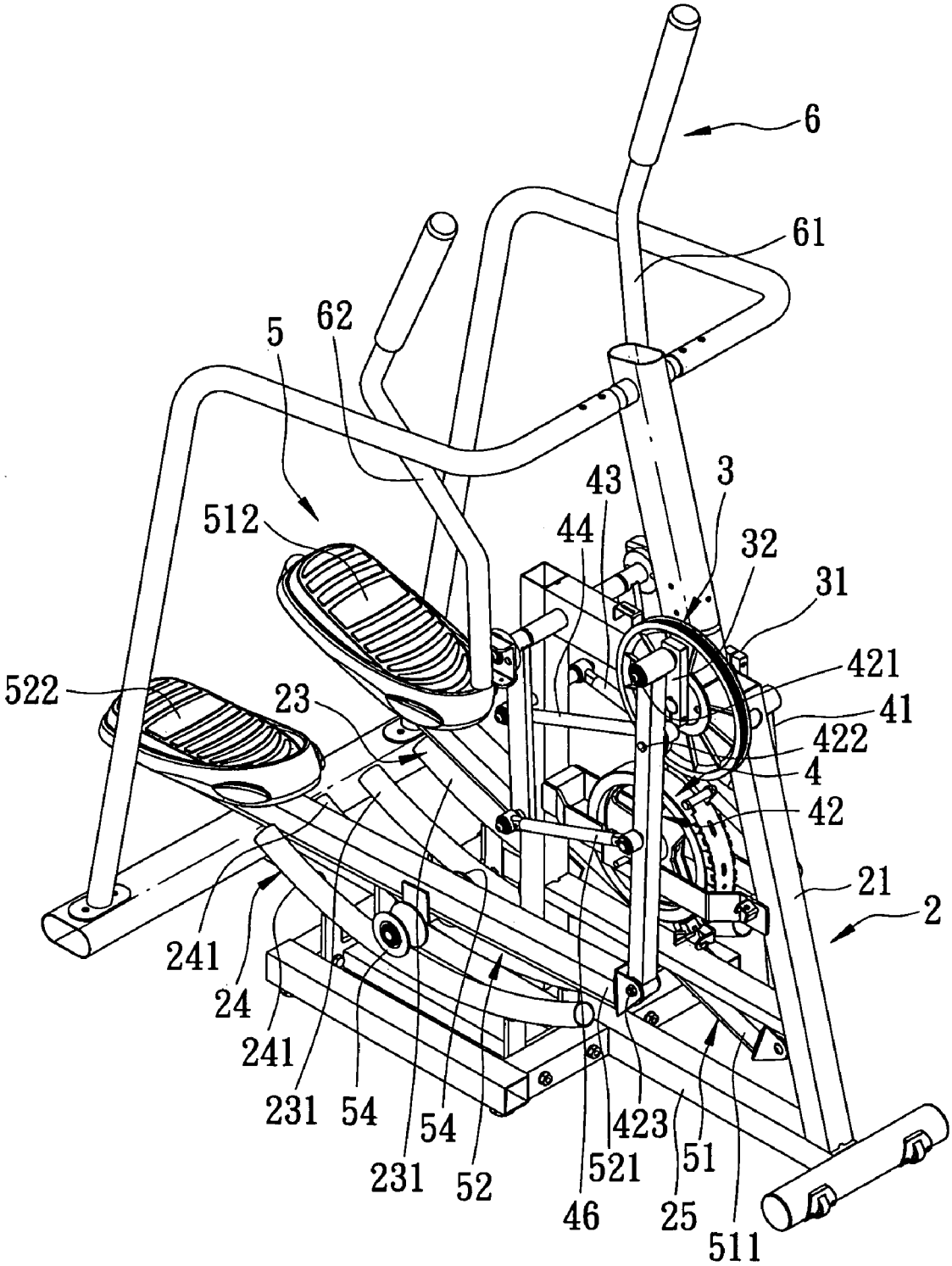
FIG. 5 is a perspective view of the first preferred embodiment.
Figure 6:
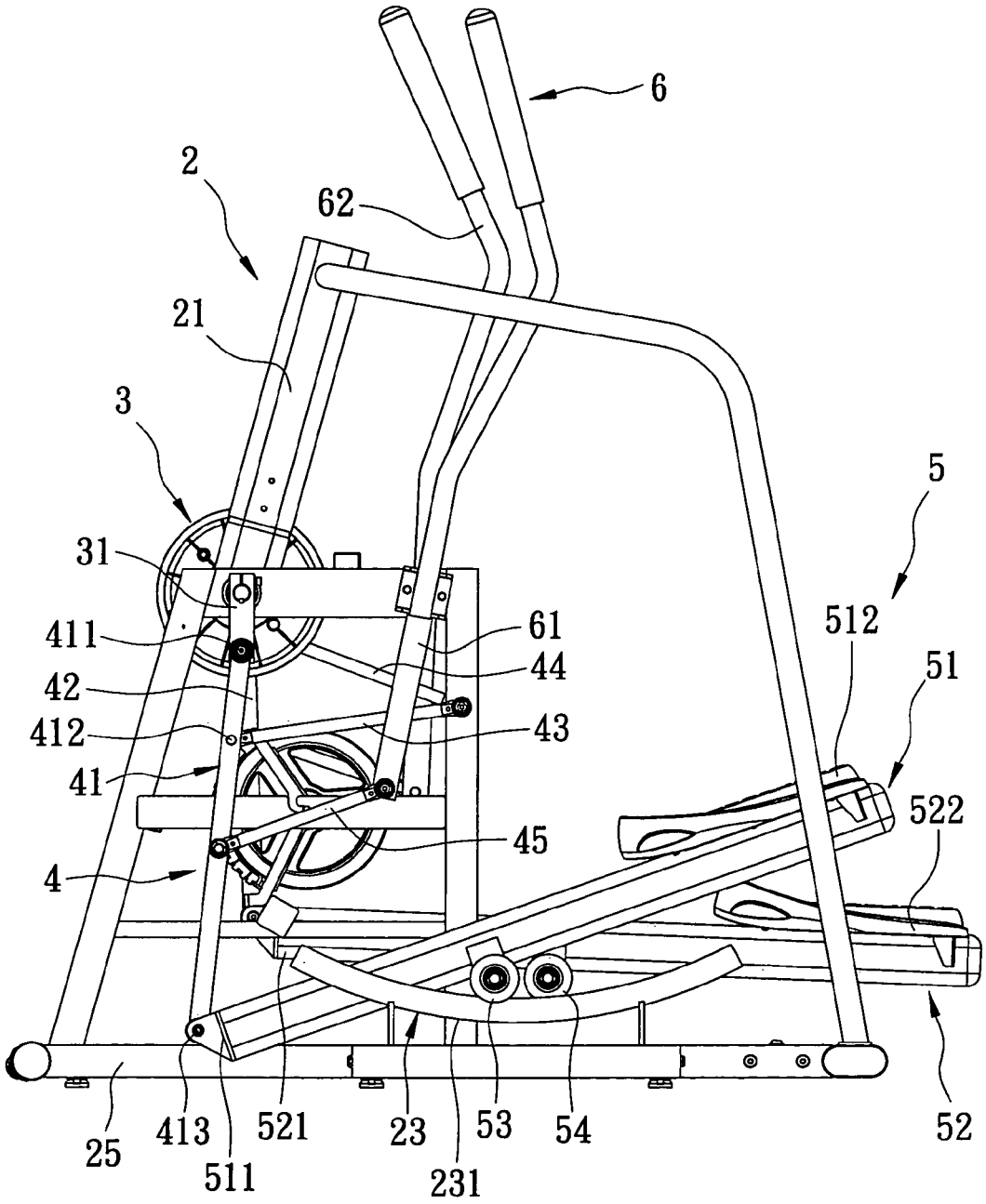
FIG. 6 is a schematic side view of the first preferred embodiment.

Referring to FIGS. 4, 5, and 6, the first preferred embodiment of an elliptical exercise apparatus according to the present invention is shown to comprise a main frame 2, a crank assembly 3, a link rod assembly 4, a pedal assembly 5, and a handle assembly 6.

The main frame 2 includes a base 25 adapted to be mounted flatly on the ground, and an upstanding frame 21 extending upwardly from the base 25 proximate to a front end thereof. The base 25 includes one left rail unit 23 and one right rail unit 24 provided respectively on left and right sides of the base 25. The left rail unit 23 includes two left curved rails 231 rising from the left side of the base 25. The right rail unit 24 includes two right curved rails 241 rising from the right side of the base 25. Each of the left and right curved rails 231, 241 has upwardly curved front and rear ends, and a downwardly indented intermediate part elevated from the base 25.

The crank assembly 3 includes left and right crank members 31, 32 connected rotatably and respectively to left and right sides of the upstanding frame 21 proximate to a front end thereof.

The link rod assembly 4 includes left and right first link rods 41, 42, left and right second link rods 43, 44, and left and right third link rods 45, 46. The first link rods 41, 42 have first connection points 411, 421 connected pivotally and respectively to the left and right crank members 31, 32, second connection points 412, 422 below the first connection points 411, 421, and third connection points 413, 423 below the second connection points 413, 423. Each of the second link rods 43, 44 has two opposite rear and front ends connected pivotally and respectively to the upstanding frame 21 proximate to a rear end of the upstanding frame 21, and to the second connection point 412, 422 of the corresponding one of the first link rods 41, 42, so that the second connection point 412, 422 of each first link rod 41, 42 is limited to move along a predetermined path.

The pedal assembly 5 includes left and right pedal rods 51, 52, each of which has a front connecting section 511, 521 connected rotatably to the third connection point 413, 423 of the corresponding first link rod 41, 42, and a pedal member 512,522 disposed rearwardly of the front connecting section 511, 521. Each of the left and right pedal rods 51, 52 further has a pair of rollers 53, 54 that are provided between the front connecting section 511, 521 and the pedal member 512, 522 of the corresponding pedal rod 51, 52, that are fixed respectively to two opposite sides of the corresponding pedal rod 51, 52, and that are slidable on the respective curved rails 231, 241. The left and right pedal rods 51, 52 are mounted on the base 25 through the rollers 53, 54 so as to move in a substantially front-to-rear direction relative to the base 25.

The handle assembly 6 includes left and right handles 61, 62 connected pivotally and respectively to the left and right sides of the upstanding frame 21 proximate to the rear end of the upstanding frame 21. Each of the left and right third link rods 45, 46 has two opposite front and rear ends connected pivotally and respectively to the corresponding one of the first link rods 41, 42 and the corresponding one of the handles 61, 62.

The pedal members 512, 522 of the pedal rods 51, 52 are movable along an elliptical path between a rising position and a downward stepping position. When the right leg of the user steps down on the pedal member 522 to move the pedal member 522 rearward, the rollers 54 of the right pedal rod 52 are slid rearwardly along the right curved rails 241, and the front connecting section 521 of the right pedal rod 52 moves the right first link rod 42 upward. The right first link rod 42, in turn, pushes the right third link rod 46 to move rearwardly. The right third link rod 46 then pushes the right handle 62 to rotate relative to the upstanding frame 21, thereby moving the user's right hand forwardly. Because the right second link rod 44 is connected to the upstanding frame 21, the second connection point 422 of the right first link rod 42 is limited to move along a curved path. The first connection point 421 of the right first link rod 42, in turn, urges the right crank member 32 to rotate clockwise.

When the right crank member 32 rotates clockwise, the left crank member 31 rotates counterclockwise. The left crank member 31, in turn, moves the left first link rod 41 downwardly bringing the left third link rod 45 to move forwardly. The left third link rod 45 then pushes the left handle 61 to rotate relative to the upstanding frame 21, thereby bringing the user's left hand to move rearwardly. Because the left second link rod 43 is connected to the upstanding frame 21, the second connection point 412 of the left first link rod 41 is limited to move along a curved path. During this operation, the third connection point 413 of the left first link rod 41 brings the left rollers 53 to move forwardly. Through alternate movement of the pedal members 512, 522 of the left and right pedal rods 51, 52, the user's feet can travel along a generally elliptical path during exercise.

As mentioned above, the second link rods 43, 44 have rear ends attached to the upstanding frame 21 proximate to the rear end of the upstanding frame 21, and front ends connected to the first link rods 41, 42 so that the second link rods 43, 44 do not extend beyond the portion of the upstanding frame 21 where the crank assembly 3 is mounted, and the upstanding frame 21 need not extend much beyond the crank assembly 3. As such, the distance between the front end of the upstanding frame 21 and the pedal members 512, 522 is reduced.

Therefore, the elliptical exercise apparatus of the present invention allows for exercise in which the user's feet undergo an elliptical motion, while substantially reducing the overall length and volume of the elliptical exercise apparatus of the present invention. Hence, the space required for transport, storage, and use of the present invention is minimized.

Figure 7:
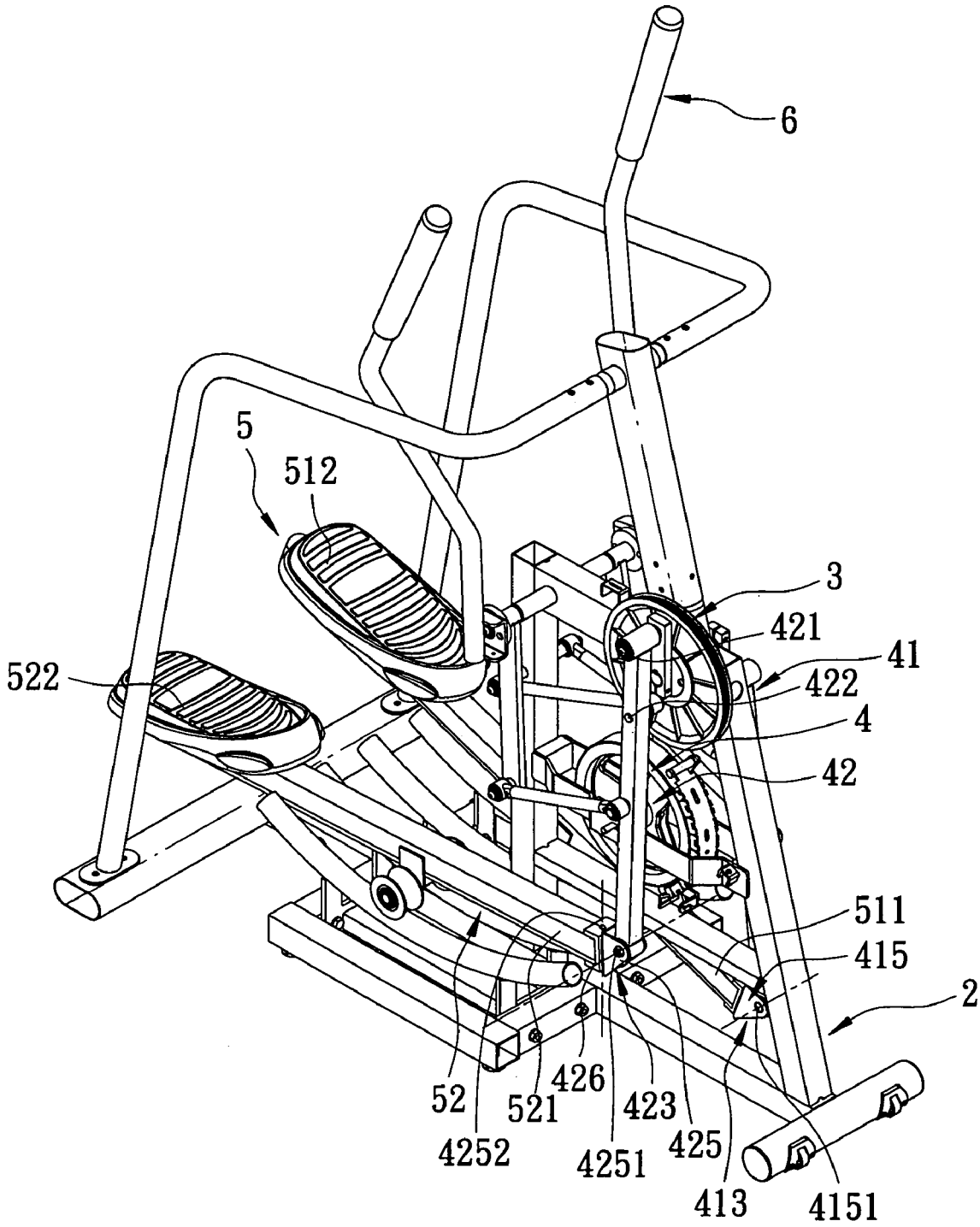
FIG. 7 is a perspective view of the second preferred embodiment of an elliptical exercise apparatus according to the present invention.
Figure 8:
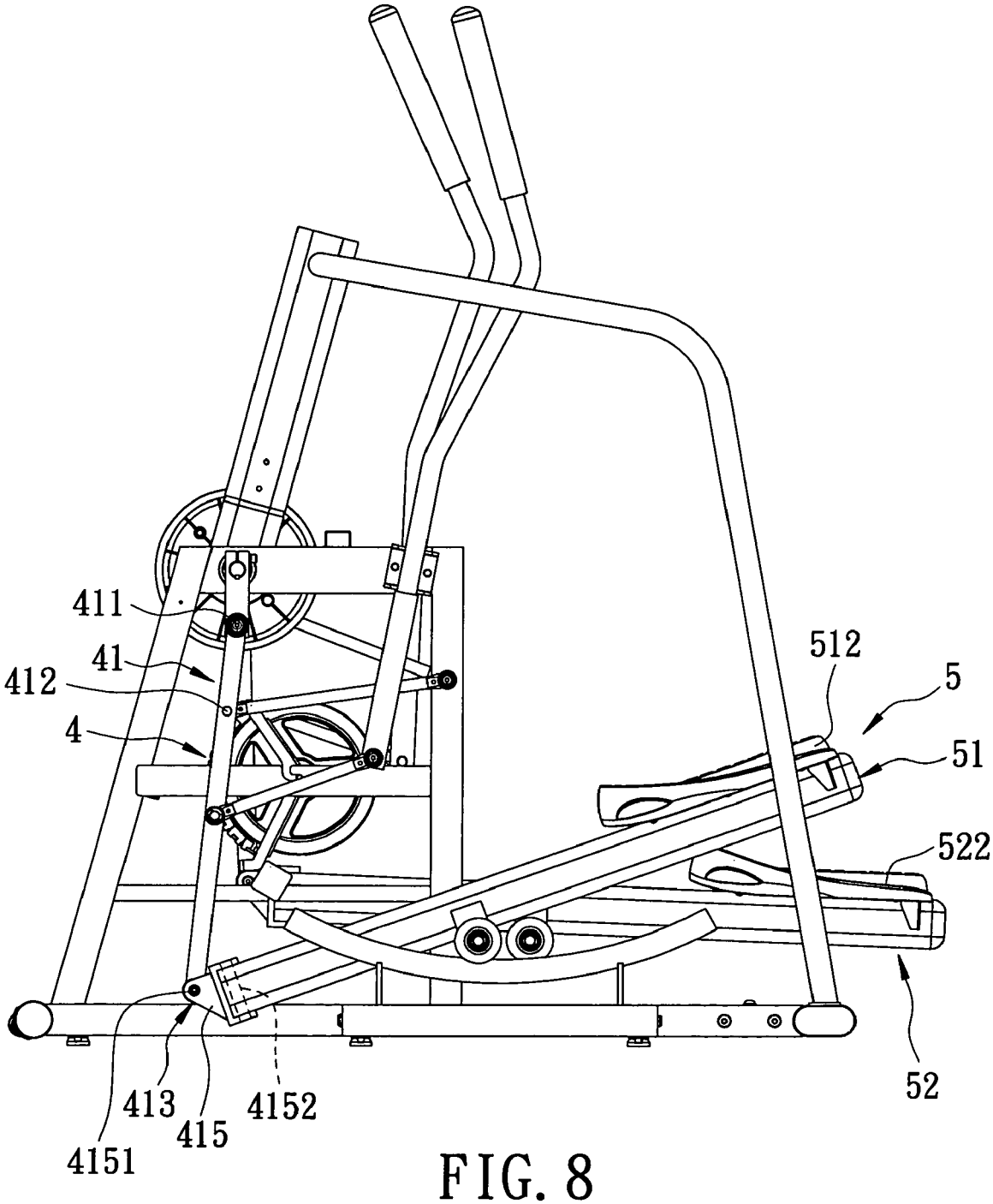
FIG. 8 is a schematic side view of the second preferred embodiment.

Referring to FIGS. 7 and 8, an elliptical exercise apparatus according to the second preferred embodiment of the present invention is shown to be similar to the first preferred embodiment. However, in this embodiment, each of the left and right first link rods 41, 42 has a universal connector 415, 425 at the respective third connection point 413, 423, the universal connector 415, 425 including a first pivot member 4151, 4251 connected pivotally to the corresponding one of the first link rods 41, 42, and a second pivot member 4152, 4252 connected pivotally to the front connecting section 521, 522 of the corresponding one of the left and right pedal rods 51, 52. The first and second pivot members 4151, 4251, 4152, 4252 define two perpendicular pivot axes, and the pedal rods 51, 52 are pivotable relative to the respective first link rods 41, 42 about the two pivot axes.

The second preferred embodiment not only can attain the aforementioned advantages of the first preferred embodiment, but also, with the universal connectors 415, 425, the second embodiment permits the user to move more smoothly and comfortably.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An elliptical exercise apparatus comprising:

a main frame including a base, and an upstanding frame extending upwardly from said base proximate to a front end of said base;

a crank assembly including left and right crank members connected respectively and rotatably to left and right sides of said upstanding frame proximate to a front end of said upstanding frame;

a link rod assembly including left and right first link rods each having a first connection point, a second connection point below said first connection point, and a third connection point below said second connection point, said first connection points of said left and right first link rods being connected respectively and rotatably to said left and right crank members, said link rod assembly further including left and right second link rods, each of which has two opposite rear and front ends connected pivotally and respectively to said upstanding frame proximate to a rear end of said upstanding frame and said second connection point of a corresponding one of said left and right first link rods; and a pedal assembly including left and right pedal rods each having a front connecting section connected rotatably to said third connection point of a respective one of said left and right first link rods, and a pedal member disposed rearwardly of said front connecting section, said left and right pedal rods being slidable on said base.

2. The elliptical exercise apparatus of claim 1, wherein said base includes one left rail unit and one right rail unit, said left and right rail units being provided respectively on left and right sides of said base, each of said left and right pedal rods having at least one roller provided between said respective front connecting section and said respective pedal member and being disposed slidably on one of said left and right rail units.

3. The elliptical exercise apparatus of claim 2, wherein each of said left and right rail units includes a pair of curved rails rising from said base, each of said left and right pedal rods having two opposite sides provided respectively with a pair of said rollers to slide respectively on said pair of said curved rails of a corresponding one of said left and right rail units.

4. The elliptical exercise apparatus of claim 2, wherein each of said left and right rail units includes at least one curved rail that has upwardly curved front and rear ends and a downwardly indented intermediate part elevated from said base.

5. The elliptical exercise apparatus of claim 1, further comprising a handle assembly which includes left and right handles connected pivotally and respectively to said left and right sides of said upstanding frame proximate to said rear end of said upstanding frame, said link rod assembly further including left and right third link rods, each of said left and right third link rods having two opposite front and rear ends connected respectively and pivotally to the corresponding one of said left and right first link rods and a corresponding one of said left and right handles.

6. The elliptical exercise apparatus of claim 1, wherein each of said left and right first link rods has a universal connector at said respective third connection point, said universal connector including a first pivot member connected pivotally to the corresponding one of said left and right first link rods, and a second pivot member connected pivotally to said front connecting section of a corresponding one of said left and right pedal rods, said first and second pivot members defining two perpendicular pivot axes.

* * * * *